US010661140B2

(12) United States Patent
Collier, III

(10) Patent No.: US 10,661,140 B2
(45) Date of Patent: May 26, 2020

(54) GOLF-TRAINING APPARATUS

(71) Applicant: Johnie Collier, III, Mt. Laurel, NJ (US)

(72) Inventor: Johnie Collier, III, Mt. Laurel, NJ (US)

( * ) Notice: Subject to any disclaimer, the term of this patent is extended or adjusted under 35 U.S.C. 154(b) by 58 days.

(21) Appl. No.: 15/883,488

(22) Filed: Jan. 30, 2018

(65) Prior Publication Data

US 2019/0232139 A1 Aug. 1, 2019

(51) Int. Cl.

| | |
|---|---|
| ***A63B 69/00*** | (2006.01) |
| ***A63B 71/02*** | (2006.01) |
| ***A63B 69/36*** | (2006.01) |
| *A63B 102/32* | (2015.01) |
| *A63B 71/06* | (2006.01) |

(52) U.S. Cl.

CPC ..... *A63B 69/0079* (2013.01); *A63B 69/3623* (2013.01); *A63B 69/3655* (2013.01); *A63B 69/3661* (2013.01); *A63B 71/022* (2013.01); *A63B 2071/0694* (2013.01); *A63B 2102/32* (2015.10); *A63B 2209/14* (2013.01); *A63B 2225/093* (2013.01)

(58) Field of Classification Search

CPC ..... A63B 69/0079; A63B 69/3623; A63B 69/3655; A63B 69/3661

USPC ..... 473/147

See application file for complete search history.

(56) References Cited

U.S. PATENT DOCUMENTS

| | | | | | |
|---|---|---|---|---|---|
| 3,006,647 | A * | 10/1961 | Haskett | A63B 69/0075 | 473/143 |
| 3,169,771 | A | 2/1965 | Holmes | | |
| 3,366,383 | A * | 1/1968 | Lentine | A63B 69/0079 | 473/430 |
| 3,425,700 | A * | 2/1969 | Edwards | A63B 69/0079 | 473/147 |
| 3,731,926 | A | 5/1973 | Vincent | | |
| 3,994,494 | A | 11/1976 | Kelley | | |
| 4,556,219 | A * | 12/1985 | Tillery | A63B 63/00 | 473/197 |
| 4,993,709 | A * | 2/1991 | Tominaga | A63B 24/0021 | 473/140 |
| 5,513,842 | A | 5/1996 | Fuss | | |
| 7,850,535 | B2 | 12/2010 | Noble | | |
| 8,998,738 | B1 * | 4/2015 | Dillon | A63B 69/3661 | 473/218 |
| D805,591 | S * | 12/2017 | Miller | D21/705 | |
| 2007/0293337 | A1 * | 12/2007 | Payne | A63B 69/3652 | 473/261 |

(Continued)

FOREIGN PATENT DOCUMENTS

| | | | | |
|---|---|---|---|---|
| EP | 1371398 | A1 * | 12/2003 | A63B 63/00 |
| GB | 2254261 | A1 | 10/1992 | |

*Primary Examiner* — John E Simms, Jr.
*Assistant Examiner* — Rayshun K Peng
(74) *Attorney, Agent, or Firm* — Axenfeld Law Group, LLC; Robert R. Axenfeld, Esq.

(57) ABSTRACT

Described is an apparatus for practicing a golf swing in either an indoor or outdoor environment. The apparatus includes a frame with a leg portion, a rebounding surface, an arm with a cord that is secured to golf ball, and a mat. A golfer can practice a golf swing by striking the ball secured to the cord, and receives instantaneous feedback based on the ball's trajectory, sound produced when the ball hits the rebounding surface, and divot markings imprinted on the mat.

7 Claims, 9 Drawing Sheets

(56) References Cited

U.S. PATENT DOCUMENTS

2013/0210590 A1 8/2013 Publicover

* cited by examiner

GOLF-TRAINING APPARATUS

BACKGROUND

Golf is a difficult sport to master. And improving a golfer's golf swing requires time and much practice. Most golfers, however, are forced to limit their practice to the golf course, a driving range, or a golf-training facility.

In other words, there is limited opportunity to practice hitting a golf ball with a golf club (such as an iron) at home that fully simulates the experience of actually hitting a real golf ball on a golf course with immediate feedback. In addition, in order to be able to practice on a consistent basis at home, golfers need to be able to practice indoors, which allows them to practice independent of weather conditions or time of day.

Previous indoor golf practice devices miss integral aspects of the golf-swing-practice experience when using a golfer's irons (i.e., such as the three iron through pitching/sand wedge). While hitting a golf ball is integral to effective golf swing practice, most indoor golf practice inventions miss this part, because the devices fail to allow the golfer to strike a real golf ball with full force inside a house.

And devices that involve allowing a golfer to actually strike a real golf ball indoors miss other aspects of the golf swing practice experience, such as allowing the golfer to analyze the trajectory of the ball after it is hit. Some devices also use adjusted, weighted, altered, or substituted equipment, which does not allow the golf to develop muscle memory that translates directly to using the actual clubs and golf balls the golfer would use on the golf course.

SUMMARY

Described is a golf-training apparatus that addresses many of the deficiencies discussed above.

In one embodiment, the apparatus includes a frame, a rebounding surface, an extension arm, a cord, and an optional mat. The frame may rest on the floor, or be connected to the ceiling or a wall. The frame generally supports the rebounding surface in a substantially coplanar position with the ground surface, and about four and eight feet above the ground surface.

The extension arm is connected adjacent to the frame and the rebounding surface, and extends in a horizontal fashion away from the frame and rebounding surface. The extension arm may be repositioned on either the left or right side of the rebounding surface to adjust for the golfer's handedness.

The cord is secured to the arm at the end of the extension arm opposite of the frame. That is, the cord is vertically suspended from the arm opposite the frame. The unsecured end of the cord may be connected to a golf ball that rests on a mat or on the ground surface itself. The cord generally restricts movement of the golf ball in a circular-longitudinal path toward the rebounding surface after the golf ball is struck in the direction of the rebounding surface by a golfer. The rebounding surface stops the golf ball after being struck by a golfer. That is the rebounding surface dissipates the force of the ball so that the golf ball falls back toward the ground surface in a controlled and safe manner after the ball hits the rebounding surface.

In one example, the rebounding surface may also produce an audible sound when struck by a golf ball. For instance, if the golf ball makes contact with the center of the rebounding surface it will produce a deep bass sound. Whereas if the golf ball hits the outer periphery of the rebounding surface, it will produce a higher-pitch sound. The audible sound allows the golfer to know if the ball was struck properly, or hit in a non-straight line, such as hooked/sliced. For instance, if the golf ball impacts the center of the rebounding surface after a practice shot, it produces a deep bass sound. In contrast, if the golf ball is miss-hit or hit on a trajectory that isn't straight, than the ball will tend to make contact with an outer peripheral position of the rebounding surface, which in turn, may produce a sharper higher-pitch sound.

Thus, based on the motion of the ball along the circular-longitudinal path, and the sound produced when the ball hits the rebounding surface, and any divot marks on the mat (if chalk is used on the golfer's club or the mat is made of a material that allows such marks), the golfer can use the apparatus to judge the quality of the golfer's swing. The divot marks can also be used to judge whether the golf club hits the ground before or after hitting the ball.

This summary is provided to introduce a selection of concepts in a simplified form that are further described below. This summary is not necessarily intended to identify key features or essential features of the claimed subject matter, nor is it necessarily intended to be used as an aid in determining the scope of the claimed subject matter.

The foregoing outlines examples of this disclosure so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

Reference herein to "one embodiment," "an embodiment," "an aspect," "an implementation," "an example," or similar formulations, means that a particular feature, structure, operation, or characteristic described in connection with the embodiment is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

BRIEF DESCRIPTION OF THE DRAWINGS

The detailed description is described with reference to the accompanying figures. In the figures, the left-most digit(s) of a reference number identifies the figure in which the reference number first appears. The figures are not necessarily drawn to scale.

DETAILED DESCRIPTION

Described is an apparatus for practicing a golf swing in either an indoor or outdoor environment that provides immediate feedback based on ball trajectory, the sound produced when the golf ball impacts a rebounding surface (to be described herein), and any divot marks left in a golf mat. Some embodiments of the apparatus may be described with reference to FIGS. 1 through 7.

Figure 1:
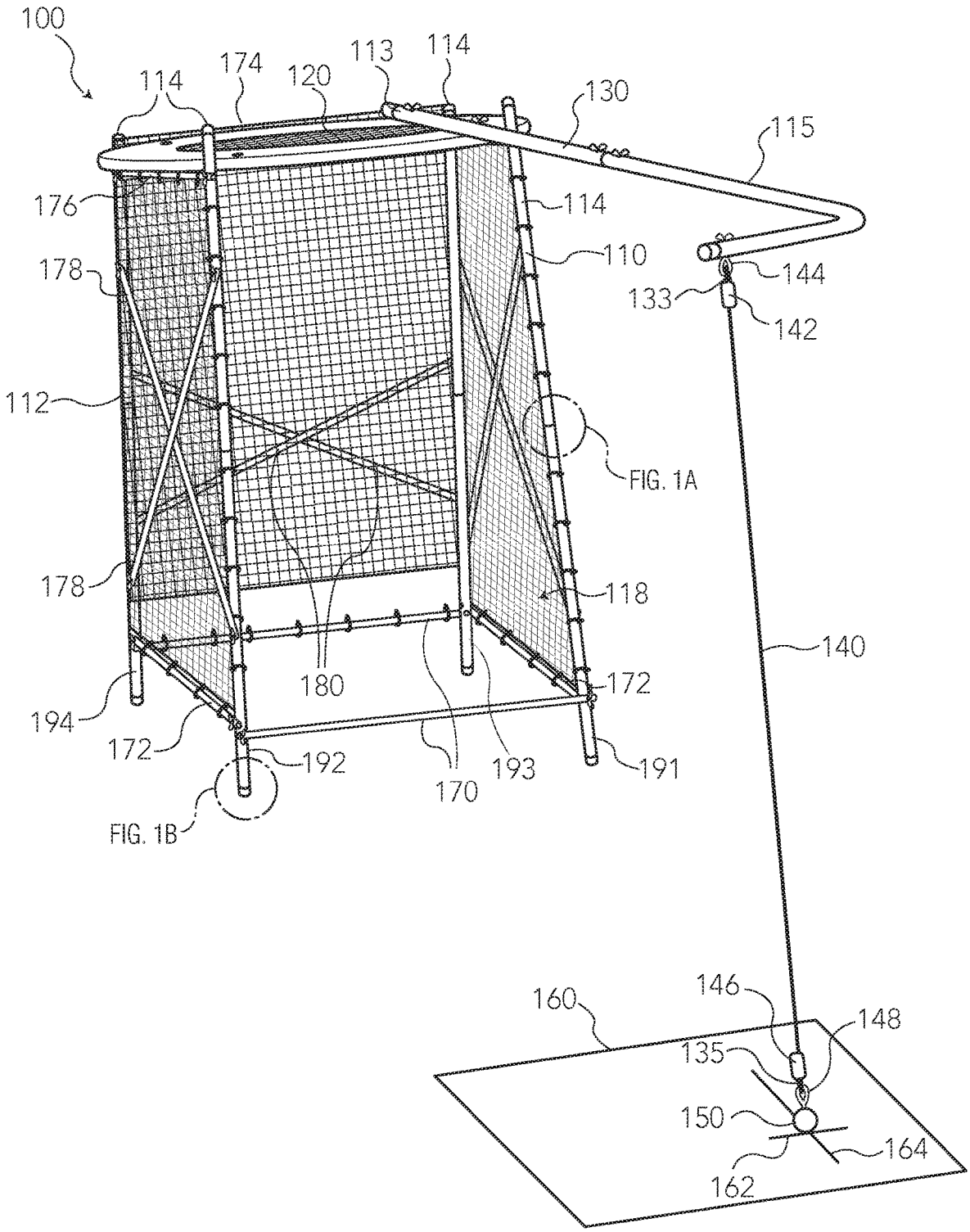
FIG. 1 shows a perspective view of an embodiment of the golf training apparatus.

FIG. 1 shows a perspective view of an embodiment of the golf training apparatus 100. Apparatus 100 may include a frame 110, a rebounding surface 120, an extension arm 130, a cord 140, a golf ball 150, and a mat 160.

Frame

Frame 110 generally supports rebounding surface 120 in a substantially coplanar position with the ground surface, between about four and eight feet above the ground surface. As appreciated by those skilled in the art after having the benefit of this disclosure, rebounding surface 120 may be angled so it is not exactly parallel with the ground surface. In addition, rebounding surface may be lower than four feet, such as for use with young children.

Frame 110 includes a leg portion 112, which supports the weight of apparatus 100. In the embodiment shown in FIG. 1, frame 110 resides on the ground and is supported by a leg portion 112. Leg portion 112 may include legs 114, which are configured to support the weight of apparatus C 100. Although four legs 114 are depicted in the embodiment of FIG. 1, leg portion 112 could include more than four legs, or could be a unitary stand (not shown) configured to rest on the ground.

Figure 1A:
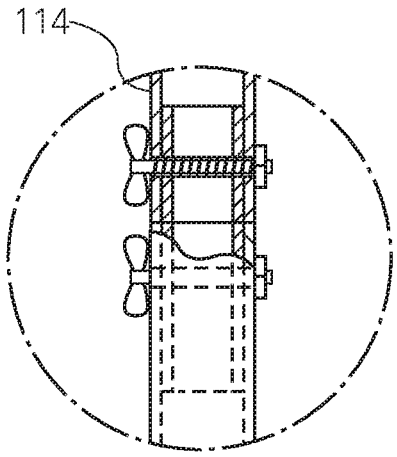
FIG. 1A shows a magnified view of the connecting pieces in the midsection of a leg in an embodiment of the golf training apparatus.

FIG. 1A shows a magnified view of the connecting pieces in the midsection of a leg 114 in an embodiment of the golf training apparatus, As depicted in FIG. 1A, each leg 114 may include two rods connected together for easy assembly or disassembly. Alternatively, each leg 114 may be unitary, i.e., composed of a single rod (not shown).

Figure 1B:
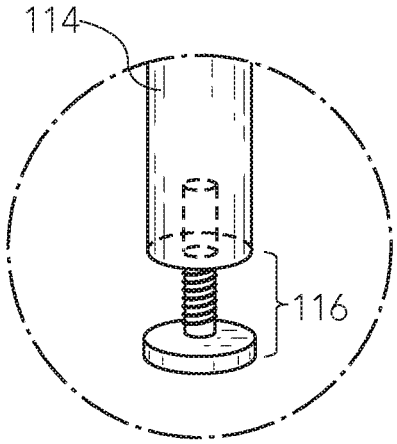
FIG. 1B shows a magnified view of a leg that is adjustable for height at the feet in an embodiment of the golf training apparatus.

In addition, each leg 114 of frame 110 may be adjustable in height, by raising or lowering each leg 114. For instance, FIG. 1B shows a magnified view of a leg that is adjustable in height. That is, FIG. 1B shows a leg 114 with an adjustable foot 116. Legs 114 may also include other types of feet such as spikes, suction cups, pads, or any combination thereof (not shown). Legs 114 can include wheels (not shown) at the ground end to enable easy positioning of apparatus 100.

In the embodiment shown in FIG. 1, frame 110 includes an arrangement of support rods to connect legs 114. The right front leg 191 is connected to the left front leg 192 and right rear leg 193 is connected to the left rear leg 194 with two horizontally positioned rods 170 several inches above the base of each leg. Right front leg 191 is connected to right rear leg 193 and left front leg 192 is connected to left rear leg 194 with two horizontally positioned rods 172 several inches above the base of each leg. Right rear leg 193 and left rear leg 194 are connected at the top by rod 174. Right front leg 191 is connected to right rear leg 193 and left front leg 192 is connected to left rear leg 194 with two rods 176 a few inches below C the top. There are two support rods 178 on the left side of frame 110 that connect the left legs as follows; one connects to front left leg 192 several inches above rod 172 and connects at the other end to rear left leg 194 several inches below rod 176, while the second connects to rear left leg 194 several inches above rod 172 and connects at the other end to front left leg 192 several inches below rod 176. There is a mirrored arrangement of support rods on the right side of frame 110 connecting the right legs. There are two support rods 180 on the rear side of the frame connecting the rear legs; one connects to rear left leg 194 several inches above 170 and connects at the other end to rear right leg 193 several inches above the midpoint of that leg while the second connects to rear right leg 193 several inches above 170 and connects at the other end to rear left leg 194 several inches above the midpoint of that leg. Frame 110 can include any number (including zero) of support rods in any configuration as long as legs 114 are stable and support the weight of apparatus (not shown).

All of the aforementioned parts of frame 110 may be composed of any suitable hard material such as aluminum, steel, wood, plastic, or any combination thereof.

Still referring to FIG. 1, frame 110 is covered on three sides with safety netting 118, but safety netting 118 need not be included (not shown). In the pictured embodiment, safety netting 118 is connected to frame 110 with a series of eyelets and ties as shown in FIG. 2B, but safety netting 118 could be connected using other connection methods such as buttons and snaps, twisting pegs, or a hook and latch system (not shown). Safety netting 118 may be composed of any suitable flexible, resilient netting C material such as mesh nylon netting.

Rebounding Surface

Still referring to FIG. 1, apparatus 100 includes rebounding surface 120 connected adjacent to frame 110, wherein the rebounding surface 120 is substantially coplanar with the ground surface, and is positioned between about four and eight feet above the ground surface.

Figure 6:
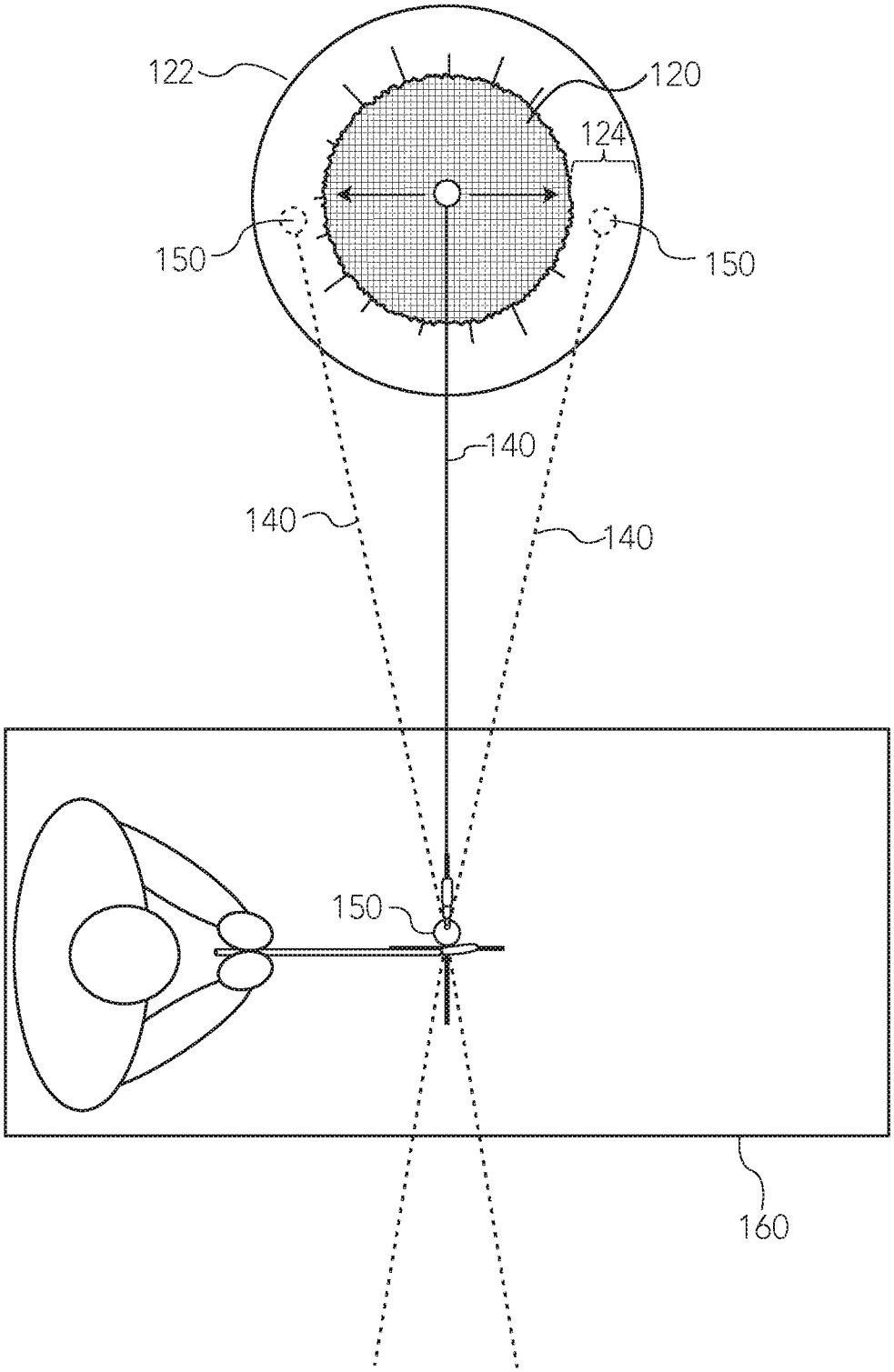
FIG. 6 shows a top view of an embodiment of the golf training apparatus with various ball trajectories based on point of contact with the rebounding surface.

Turning to FIG. 6, rebounding surface 120 is pictured as being enclosed within a circular shaped hard rail 122. Hard rail 122 need not be circularly shaped, but could take the form of any regular shape such as a square, rectangle, or triangle (not shown). FIG. 6 shows rebounding surface 120 partially covered and hard rail 122 completely covered by with a protective covering 124, but apparatus need not include protective covering 124 (not shown).

Protective covering 124 may be composed of any suitable flexible, resilient material such as thin polyvinyl chloride. Hard rail 122 may be composed of any suitable hard material such as aluminum, steel, wood, plastic, or any combination thereof. Rebounding surface 120 may be composed of any suitable stretchable-resilient material such as polypropylene mesh.

Arm

Referring back to FIG. 1, Apparatus 100 includes an arm 130 positioned with one end 113 adjacent to frame 110. Arm 130 extends horizontally away from frame 110 and rebounding surface 120 with the other end 115 extending past frame 110 and rebounding surface 120.

FIG. 1 shows arm 130 attached to frame 110 and rebounding surface C 120. However, in an alternative embodiment, arm 130 may be attached to frame 110 or rebounding surface 120 (not shown). Arm 130 may also be integrated (not shown) with frame 110.

Arm 130 could also be attached to a ceiling or wall (not shown) or setup in a configuration where an end of arm resides on the ground surface (not shown).

Figure 5A:
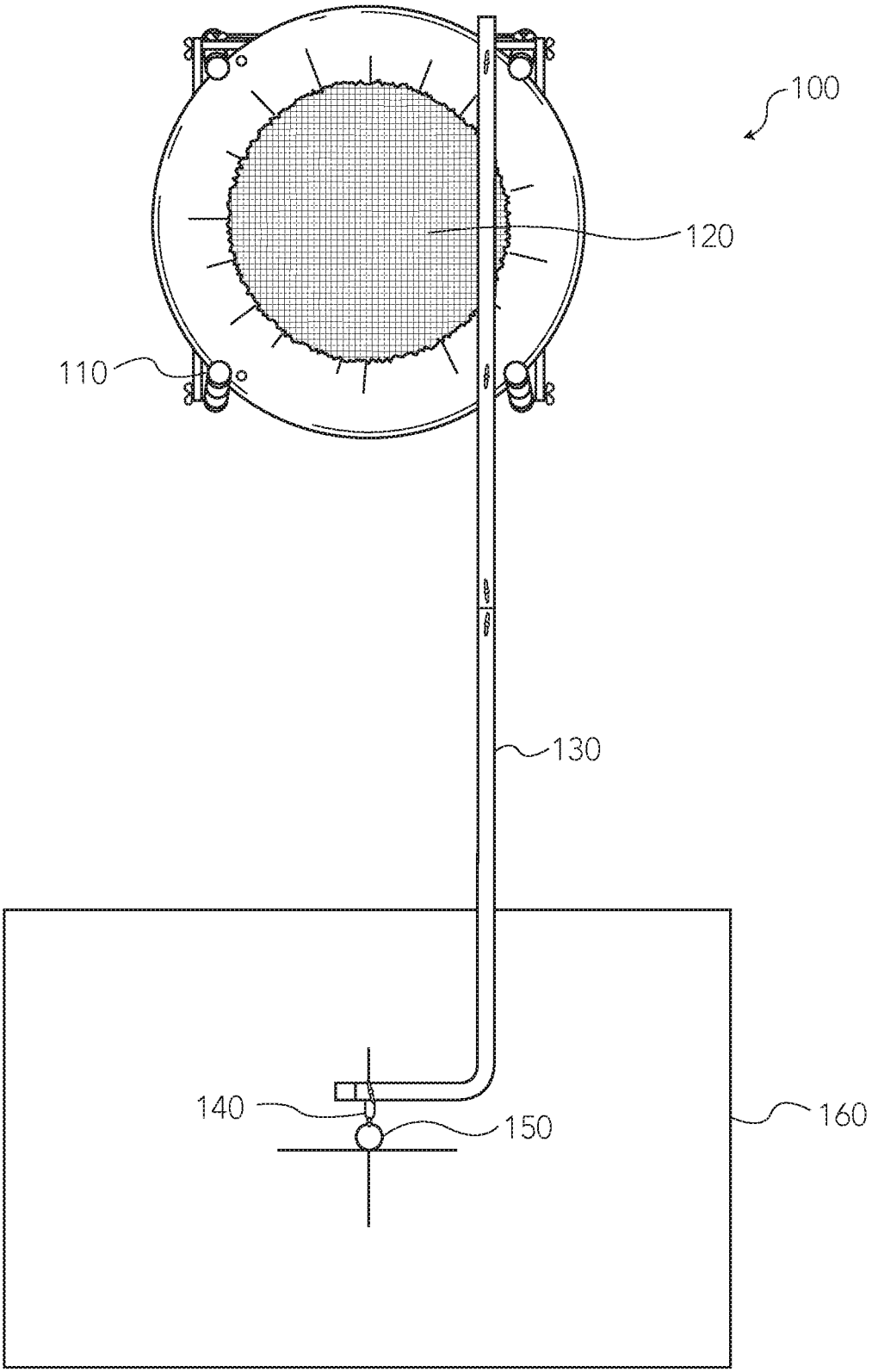
FIG. 5A shows a top view of an embodiment of the golf training apparatus with the arm set up for a right-handed player.
Figure 5B:
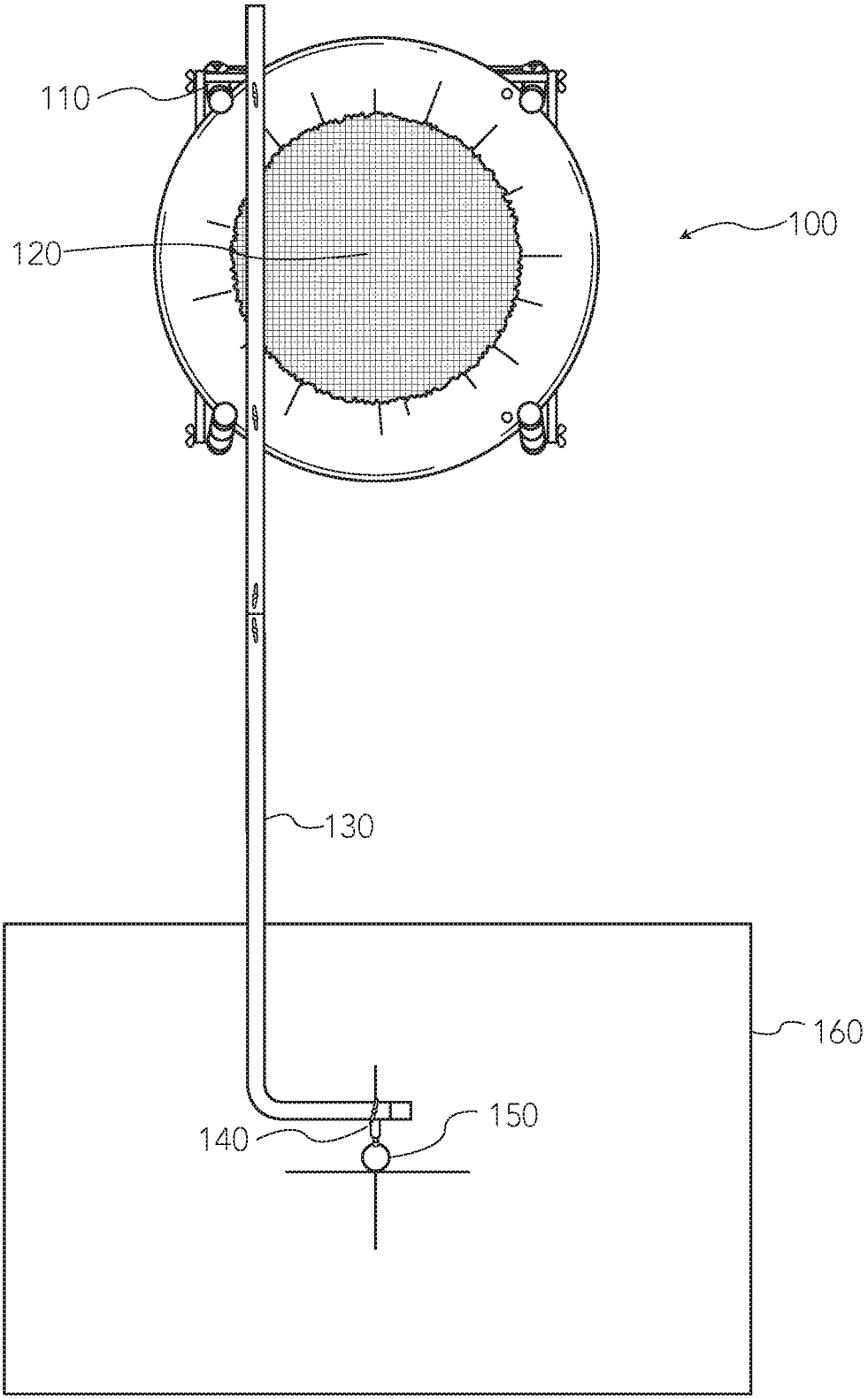
FIG. 5B shows a top view of an embodiment of the golf training apparatus with the arm set up for a left-handed player.

FIG. 1 shows arm 130 as having a 90° angle at one end, but arm 130 can take any shape that is suitable for allowing the proper functioning of apparatus 100. Arm 130 can be repositioned on either the left or right side of apparatus 100 to compensate for the golfer's handedness as shown in FIGS. 5A and 5B. All of the aforementioned parts of the arm 130 may be composed of any suitable material such as aluminum, steel, wood, plastic, or any combination thereof.

Cord

Apparatus 100 includes cord 140. As depicted in FIG. 1, cord 140 is vertically suspended from a position proximal to end 115 of arm 130. That is, an upper end 133 of cord 140 is positioned adjacent to end 115 of arm 130. Golf ball 150 is secured to a lower end 135 of cord 140.

In one embodiment, cord 140 is secured to arm 130 using an eyelet clamp 142 connected to an eyelet 144 that is screwed into arm 130, but cord 140 could be secured to arm 130 using other methods such as a clamp (not shown) or knot (not shown).

In one embodiment, lower end 135 of cord 130 is secured to golf ball 150 via an eyelet clamp 146 connected to an eyelet 148, which may be screwed into golf ball 150. As appreciated by those skilled in the art after having the benefit of this disclosure, that a sling or other suitable fastening mechanisms could be used to secure lower end 135 of cord 130 to golf ball 150.

Cord 140 may be composed of any suitable flexible, resilient, and minimally stretchable material such Kevlar cord, polyester rope, galvanized steel cable or any combination thereof. Golf ball 150 may be composed of a conventional golf ball or any suitable substitute.

Mat

Apparatus 100 includes mat 160 placed on the ground surface below the free end of arm 130 positioned such that golf ball 150 rests on mat 160. Mat 160 may be composed of any suitable semi-hard, resilient material such rubber, artificial turf, or any combination thereof. Mat 160 has placement and guidance markings 162 and 164 that may be placed on the mat beforehand by a golfer, or permanently affixed to the mat. Placement and guidance markers 162 and 164 may be composed of any suitable marking material such as ink, vinyl, tape, chalk, or any combination thereof.

Ceiling Mount

Figure 7:
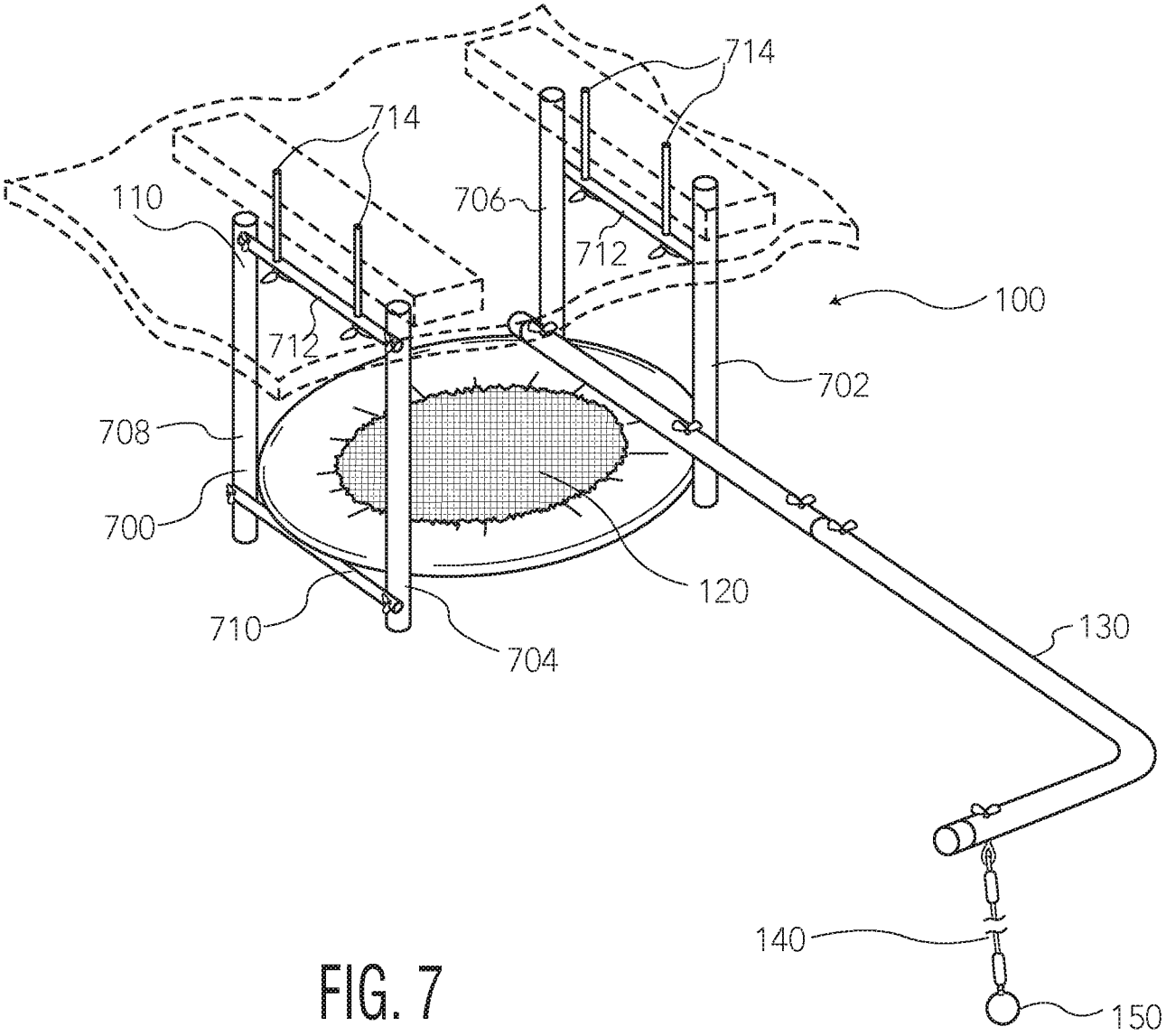
FIG. 7 shows a perspective view of an embodiment of the golf training apparatus mounted to the ceiling.

FIG. 7 shows a perspective view of another embodiment of apparatus 100. Apparatus 100 may include a frame 110, rebounding surface 120, arm 130, cord 140, golf ball 150, and mat 160.

Frame 110 includes a ceiling-mounting portion 700, which secures apparatus 100 to a ceiling. Ceiling-mounting portion 700 is configured in FIG. 7 as follows. Ceiling-mounting portion 700 includes four vertical rods: a right front rod 702, a left front rod 704, a right rear rod 706, and a left rear rod 708. Left front rod 704 is connected to left rear rod 708 and right front rod 702 is connected to right rear rod 706 a few inches from the bottom of each rod with two horizontal rods 710. Left front rod 704 is connected to left rear rod 708 and right front rod 702 is connected to right rear rod 706 a few inches from the top of each rod with two horizontal rods that have vertical screw holes 712. Apparatus 100 is secured to a ceiling using lag screws 714 that are screwed through the holes in horizontal rods 712 and into a ceiling. Ceiling mounting portion 700 need not be configured in the manner shown in FIG. 7 and apparatus can be secured to a ceiling with other methods such as gluing or welding (not shown). Parts from legs 191, 192, 193, and 194 from the embodiment of apparatus 100 shown in FIG. 1 can be used for vertical rods 702, 704, 706, and 708. Parts from horizontal rods 172 and 176 from the embodiment of apparatus 100 shown in FIG. 1 can be used for horizontal rods 710 and 712.

All of the aforementioned parts of frame 110 may be composed of any suitable material such as aluminum, steel, wood, plastic, or any combination thereof.

In this embodiment, rebounding surface 120, arm 130, cord 140, golf ball 150, and mat 160 are otherwise as described in the embodiment described with reference to a frame 110, which resides on the ground surface.

Operation

Figure 2A:
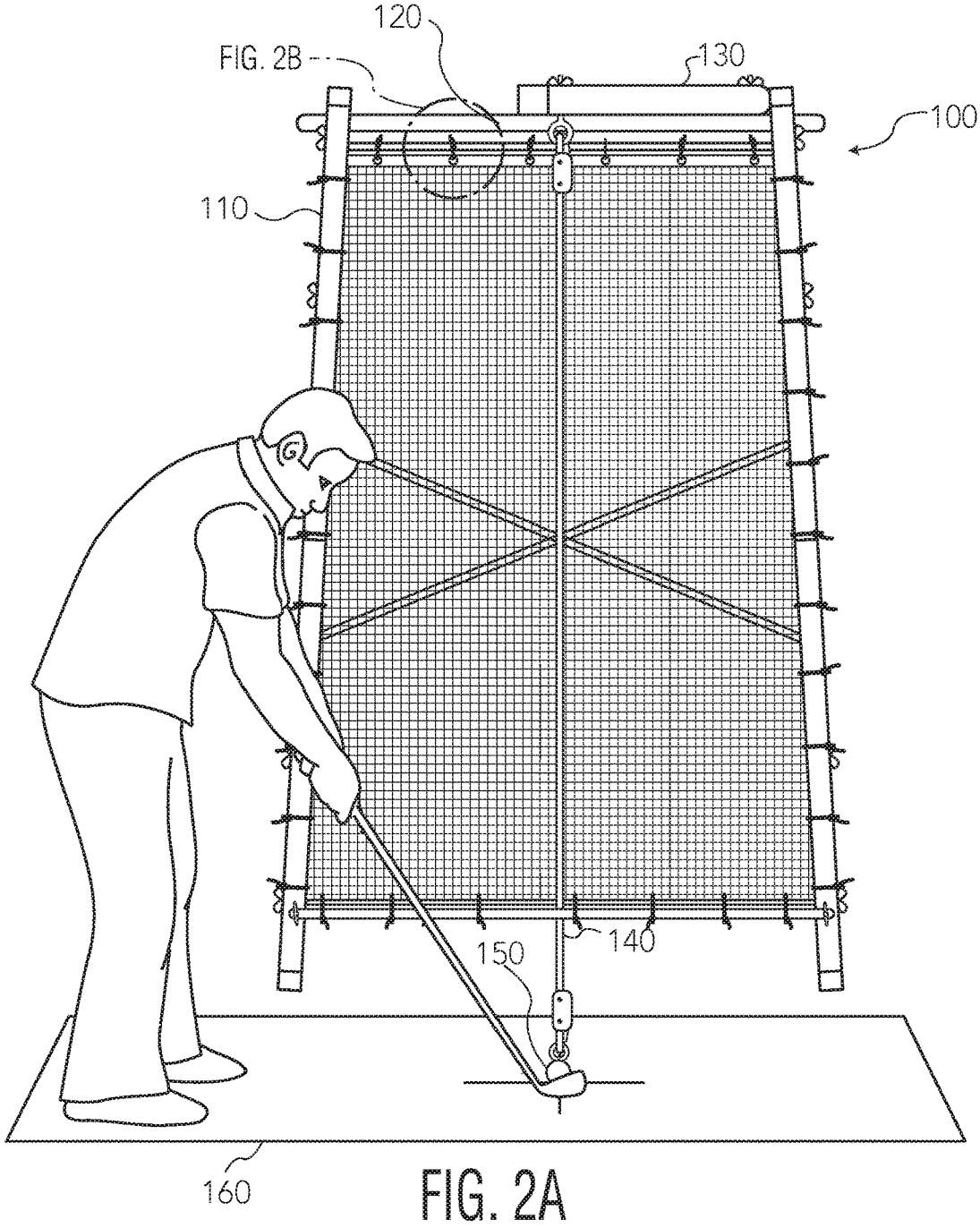
FIG. 2A shows a front view of an embodiment of the golf training apparatus with a golfer beginning a swing.
Figure 2B:
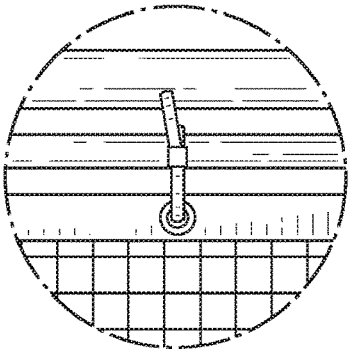
FIG. 2B shows a blown up view of the connection between the legs and the protective netting in an embodiment of the golf training apparatus.

When apparatus 100 is correctly configured, golf ball 150 will rest on mat 160 before being struck with little to no slack in cord 130, see, i.e., C FIG. 2A.

Figure 3:
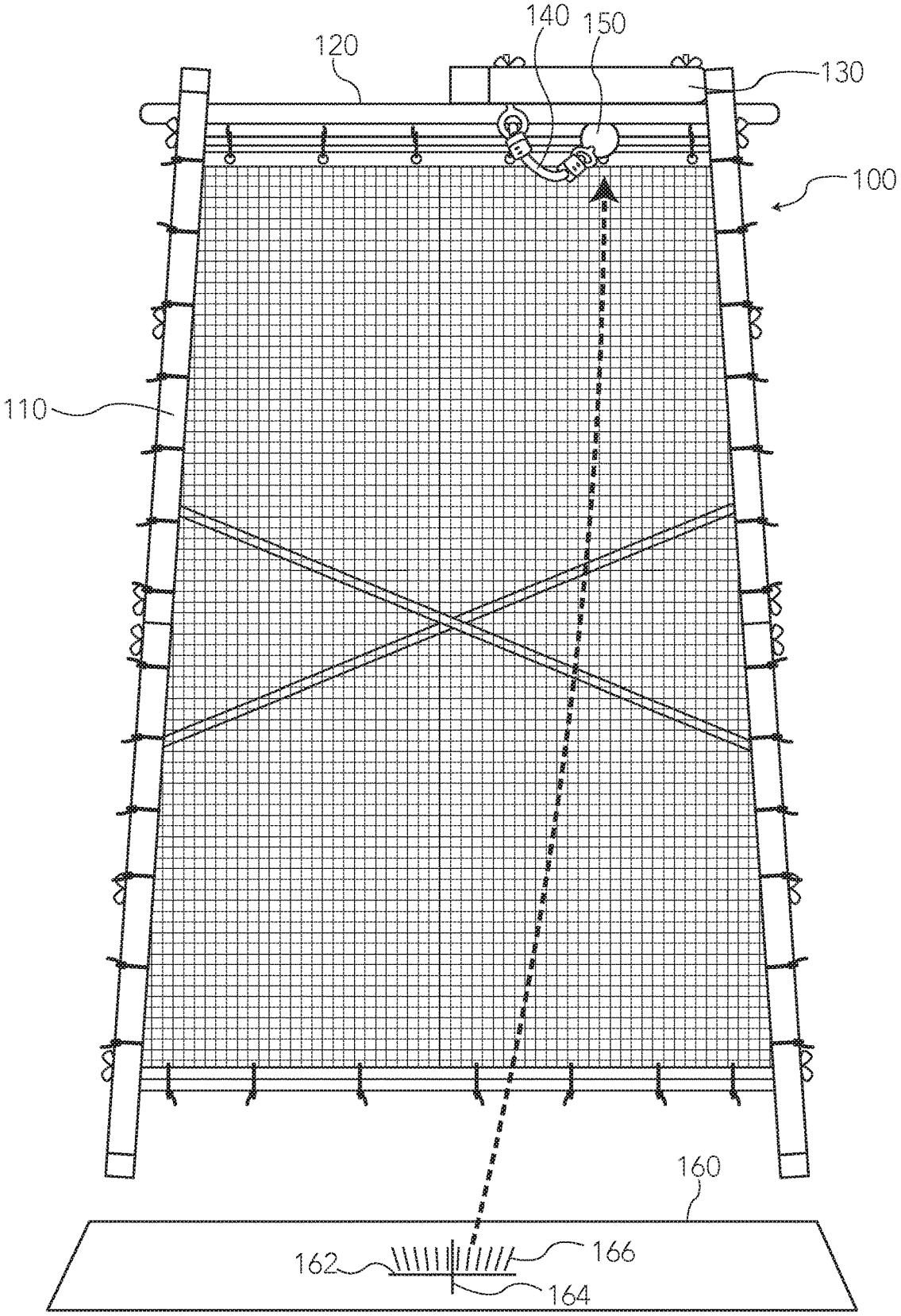
FIG. 3 shows a front view of an embodiment of the golf training apparatus where the golf ball was hit with an improper swing.
Figure 4:
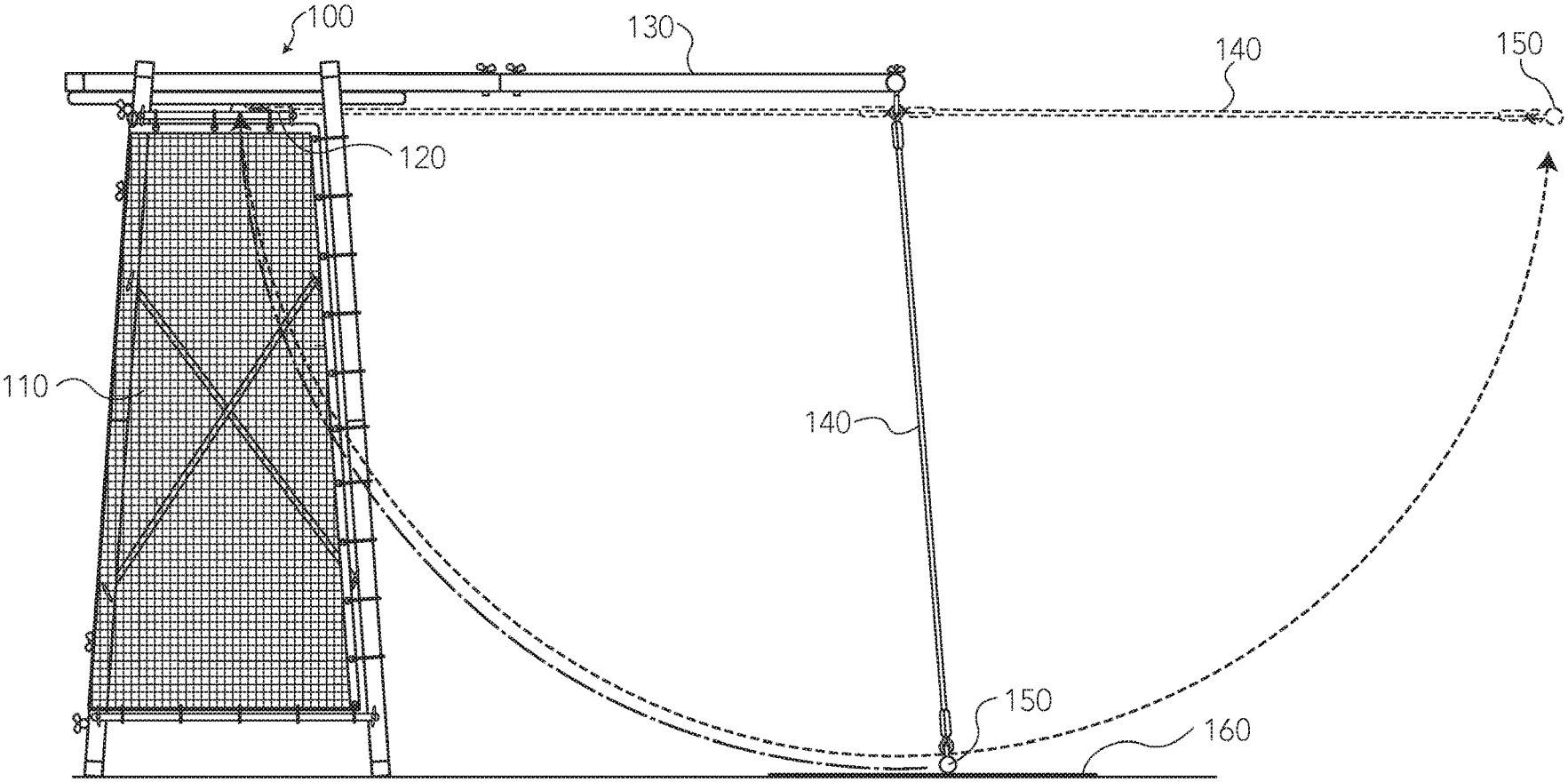
FIG. 4 shows a left side view of an embodiment of the golf training apparatus with a possible ball trajectory highlighted.

As shown in FIGS. 3 and 4, when a golfer hits golf ball 150 from mat 160, golf ball 150 will move in a circular-longitudinal path restricted by cord 140 and strike rebounding surface 120. Rebounding surface 120 will then make a sound that varies depending on where on rebounding surface 120 golf ball 150 hits, in a similar manner to the variation of sound produced when hitting the different areas of a drumhead. The golfer's swing, depending on the correctness of the stroke, may leave a divot mark 166 on mat 160 as shown in FIG. 3. The divot marks can also be used to judge whether the golf club hits the ground before or after hitting the ball. In addition, ball 150 may be sprayed with chalk or other substance, which may leave marks indicating the general direction the ball was hit.

For instance, referring to FIGS. 3 and 6, if ball 150 leaves a mark on mat 160 (or travels in a path—see FIG. 6) upon return that is almost center with the centerline—which is aligned with cord 140—then the ball was hit generally straight. If ball 150 leaves a mark (or travels in a path—see FIG. 6) upon return that is to the left or right of the centerline, then it will indicate to the golfer that that ball was hit to the left or right. If the ball returns to the right of the centerline, it generally indicates that the golfer hit the ball to the left. If the ball returns to the left of the centerline, it generally indicates that the golfer hit the ball to the right.

For example, if ball return is slightly left or right (referring to FIG. 6) it may imply a loose club grip or slightly miss alignment. If ball return is excessive left or right, ball contact may imply a miss hit or miss alignment of the ball to the rebound surface.

In addition, any sound associated with the ball contacting the rebound surface other than a deep bellow thump may imply a miss-hit ball or miss alignment; especially if ball return is something other than a straight back and forth (see FIG. 6).

When configured correctly, apparatus 100 will allow a golfer to practice their swing with their own conventional set of clubs. Allowing the golfer to practice with his or her own clubs while hitting a golf ball 150 replicates the experience of the driving range or course which allows the golfer to improve eye-hand-ball coordination and develop muscle memory for a repeatable golf club swing and consistent swing speed. Apparatus 100 can be used at home at any time, which allows a golfer to practice during the winter, bad weather, or any time the golfer has downtime. Additionally, because of the thousands of hours of golf-instructional videos available, apparatus 100 can allow a golfer to practice at home while watching the swing of a chosen golf professional.

In embodiments that include safety netting 118, safety netting 118 may prevent golf ball 150 from flying past apparatus 100, if golf ball 150 somehow becomes unsecured from cord 140 during a practice golf shot.

Thus based on the foregoing, the example apparatus 100 allows:

- golfers to swing a golf-club iron and hit a golf ball either indoor or outside;
- golfers to practice pre-shot routine for consistency;
- golfers to develop eye, hand, and ball contact coordination to improve successful play;
- for analysis of golf-club swing and golf ball contact;
- golfers to develop muscles and motor memory needed to transfer that feeling into consistent and repeatable golf-club swing, and golf-ball contact;
- for full contact iron contact with conventional equipment indoors;
- golfers to develop consistent golf club swing speed using different golf clubs by recording golf ball contact speed with the rebound surface;
- for a thump sound based on ball contact with the rebound surface that signifies a good or bad golf club swing and ball contact, depending on the pitch of the sound; and
- golfers to trust their golf swing on or off the golf course.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A golf-training apparatus, comprising: a frame having a leg portion including a first leg, a second leg, a third leg, and a fourth leg each positioned for contact with a ground surface, wherein the first leg, second leg, third leg, and fourth leg form a rectangular shape; the frame further including a first support rod, a second support rod, and a third support rod, wherein an end of the first support rod is attached to the first leg and an opposing end of the first support rod is attached to the second leg, an end of the second support rod is attached to the second leg and an opposing end of the second support rod is attached to the third leg, an end of the third support rod is attached to the third leg and an opposing end of the third support rod is attached to the fourth leg, and the first support rod, the second support rod, and the third support rod are each positioned at approximately equal heights above the ground surface substantially parallel to the ground surface; netting secured between the first leg and the second leg, between the second leg and the third leg, and between the third leg and the fourth leg; a rebounding surface having an outer edge composed of a hard material and an inner area composed of a stretchable-resilient material, wherein the outer edge forms a circular shape around the inner area and the stretchable-resilient material of the inner area is attached to the outer edge, wherein the rebounding surface is connected to the first support rod, the second support rod, and the third support rod adjacent to the frame such that the first leg, second leg, third leg, and fourth leg each contact the outer edge of the rebounding surface, the rebounding surface is substantially parallel with the ground surface, and the rebounding surface is positioned between about four and eight feet above the ground surface; an arm, having a first-end portion positioned opposite a second-end portion, wherein the first-end portion is positioned adjacent to the frame and the rebounding surface, wherein the second-end portion extends horizontally between the first leg and the fourth leg away from the frame and rebounding surface; and a cord vertically suspended from the arm, the cord having a first end secured to the second-end portion of the arm, and having a second end, which hangs free for connection to a golf ball, wherein the second end of the cord is configured to be secured to a golf ball, wherein the cord restricts movement of the golf ball in a circular-longitudinal path toward the rebounding surface after the golf ball is struck in the direction of the rebounding surface by a golfer; wherein the inner area of the rebounding surface is configured to stop upward longitudinal movement of the golf ball as the golf ball travels along the circular path from the ground surface to the rebounding surface; wherein the rebounding surface is further configured to produce a deep bass sound when struck at a central portion of the inner area of the rebounding surface; and a mat for the golf ball to be struck from with markings to indicate where the golf ball should be placed and to judge the angle of motion of the golf ball.

2. The apparatus of claim 1, further comprising an eyelet for connecting the first end of the cord to the second-end portion of the arm.

3. The apparatus of claim 1, further comprising an eyelet for connecting the second end of the cord to a golf ball.

4. The apparatus of claim 1, wherein the leg portion is adjustable for height.

5. A method of assembling a golf-training apparatus, comprising:

assembling a frame having a leg portion for resting upon a ground surface having a first leg, a second leg, a third leg, and a fourth leg;

the frame further including a first support rod, a second support rod, and a third support rod, wherein an end of the first support rod is attached to the first leg and an opposing end of the first support rod is attached to the second leg, an end of the second support rod is attached to the second leg and an opposing end of the second support rod is attached to the third leg, an end of the third support rod is attached to the third leg and an opposing end of the third support rod is attached to the fourth leg, and the first support rod, the second support rod, and the third support rod are each positioned at approximately equal heights above the ground surface substantially parallel to the ground surface;

securing netting between the first leg and the second leg, between the second leg and the third leg, and between the third leg and the fourth leg;

connecting a rebounding surface having an outer edge composed of a hard material and an inner area composed of a stretchable-resilient material to the first support rod, the second support rod, and the third support rod such that the rebounding surface is adjacent to the frame, the outer edge of the rebounding surface contacts the first leg, second leg, third leg, and fourth leg, the rebounding surface is substantially parallel with the ground surface, the rebounding surface and is positioned between about four and eight feet above the ground surface, wherein the outer edge forms a circular shape around the inner area where the stretchable-resilient material is attached to the outer edge such that when a central portion of the inner area is struck, the rebounding surface produces a deep bass sound;

connecting an arm to the frame and/or the rebounding surface, the arm having a first-end portion positioned opposite a second-end portion, wherein the first-end portion is positioned adjacent to the frame and the rebounding surface, wherein the second-end portion extends horizontally between the first leg and the fourth leg away from the frame and rebounding surface;

suspending a cord vertically from the arm, the cord having a first end secured to the second-end portion of the arm, and having a second end, which hangs free for connection to a golf ball, wherein the second end of the cord is configured to be secured to a golf ball, wherein the cord restricts movement of the golf ball in a circular-longitudinal path toward the rebounding surface after the golf ball is attached to the cord, and is struck in the direction of the rebounding surface by a golfer; and placing a mat underneath the cord for the golf ball to be struck from with markings to indicate where the golf ball should be placed and to judge the angle of motion of the golf ball.

6. The method of claim 5, further comprising securing a golf ball to the cord.

7. A method for assembling and using a golf-training apparatus, comprising:

erecting a frame having a leg portion including a first leg, a second leg, a third leg, and a fourth leg each of which includes an adjustable foot positioned for contact with a ground surface, wherein the first leg, second leg, third leg, and fourth leg form a rectangular shape;

the frame further including a first support rod, a second support rod, and a third support rod, wherein an end of the first support rod is attached to the first leg and an opposing end of the first support rod is attached to the second leg, an end of the second support rod is attached to the second leg and an opposing end of the second support rod is attached to the third leg, an end of the third support rod is attached to the third leg and an opposing end of the third support rod is attached to the fourth leg, and the first support rod, the second support rod, and the third support rod are each positioned at approximately equal heights above the ground surface substantially parallel to the ground surface;

securing netting between the first leg and the second leg, between the second leg and the third leg, and between the third leg and the fourth leg;

connecting a rebounding surface to the first support rod, the second support rod, and the third support rod of the frame such that the first leg, second leg, third leg, and fourth leg each contact an outer edge of the rebounding surface, the rebounding surface is substantially parallel with the ground surface, and the rebounding surface is positioned between about four and eight feet above the ground surface, wherein the rebounding surface has an outer edge composed of a hard material and an inner area composed of a stretchable-resilient material, wherein the outer edge forms a circular shape around the inner area where the stretchable-resilient material is attached to the outer edge such that when a central portion of the inner area is struck, the rebounding surface produces a deep bass sound;

positioning an arm, having a first-end portion opposite a second-end portion, wherein the first-end portion is adjacent to the frame and the rebounding surface and the second-end portion extends horizontally between the first leg and the fourth leg away from the frame and rebounding surface, wherein the arm further comprises an eyelet positioned at a distal end of the arm opposite the rebounding surface and the eyelet is configured to connect to an end of a cord;

suspending a cord vertically from the arm such that a first end of the cord is secured to the eyelet positioned at a distal end of the arm opposite the rebounding surface and a second end of the cord hangs free for connection to a golf ball, wherein the cord is configured to restrict movement of the golf ball in a circular-longitudinal path toward the rebounding surface after the golf ball is struck in the direction of the rebounding surface by a golfer;

securing a golf ball to the second end of the cord;

placing a mat under the golf ball for the golf ball to be struck from with markings to indicate where the golf ball should be placed and to judge the angle of motion of the golf ball;

hitting the golf ball toward the rebounding surface with a golf club using a golf swing motion;

listening for a sound produced by the rebounding surface when hit by the golf ball, wherein the rebounding surface produces a deep bass sound when the golf ball is hit correctly;

and using the characteristics of the sound to judge whether the golf ball was hit using the correct golf swing motion.

* * * * *